US009598830B2

(12) United States Patent
Nedwed et al.

(10) Patent No.: US 9,598,830 B2
(45) Date of Patent: Mar. 21, 2017

(54) METHOD AND SYSTEM FOR OIL RELEASE MANAGEMENT

(71) Applicant: EXXON-MOBIL UPSTREAM RESEARCH COMPANY, Houston, TX (US)

(72) Inventors: Timothy J. Nedwed, Houston, TX (US); Amy C. Tidwell, Houston, TX (US); Ian A. Buist, Braeside, CA (US); Randall C. Belore, Woodlawn, CA (US); David W. Cooper, Greely, CA (US)

(73) Assignee: ExxonMobil Upstream Research Company, Spring, TX (US)

( * ) Notice: Subject to any disclaimer, the term of this patent is extended or adjusted under 35 U.S.C. 154(b) by 81 days.

(21) Appl. No.: 14/408,241

(22) PCT Filed: Jul. 2, 2013

(86) PCT No.: PCT/US2013/049076
§ 371 (c)(1),
(2) Date: Dec. 15, 2014

(87) PCT Pub. No.: WO2014/014656
PCT Pub. Date: Jan. 23, 2014

(65) Prior Publication Data

US 2015/0284925 A1 Oct. 8, 2015

Related U.S. Application Data

(60) Provisional application No. 61/673,112, filed on Jul. 18, 2012.

(51) Int. Cl.
*E02B 15/04* (2006.01)
*F23G 7/05* (2006.01)

(52) U.S. Cl.
CPC ..... *E02B 15/042* (2013.01); *E02B 15/047* (2013.01); *E02B 15/048* (2013.01);
(Continued)

(58) Field of Classification Search
CPC .... E02B 15/042; E02B 15/047; E02B 15/048; F23G 7/05; F23G 2204/103;
(Continued)

(56) References Cited

U.S. PATENT DOCUMENTS 3,602,299 A * 8/1971 Mozic ..... E21B 43/0122 431/2
3,663,149 A 5/1972 Heagler
(Continued)

OTHER PUBLICATIONS

Belore, R.C. et al, "Air Jet Atomization and Burning of Oil Slicks," Proceedings of the Thirteenth Arctic and Marine Oilspill Program Technical Seminar, Jun. 6-8, 1990, Edmonton, Alberta, Environment Canada, Ottawa, Ontario, pp. 289-304.
(Continued)

*Primary Examiner* — Christopher Upton
(74) *Attorney, Agent, or Firm* — ExxonMobil Upstream Research Company Law Dept.

(57) ABSTRACT

Method and system is described for enhanced oil release management system by using one or more booms, one or more skimmers and one or more floating burners. The method and system may include skimmers to capture a fluid that is supplied to the floating burner.

27 Claims, 4 Drawing Sheets

(52) U.S. Cl.
CPC ..... *F23G 7/05* (2013.01); *F23G 2204/103* (2013.01); *F23G 2207/103* (2013.01); *F23G 2900/7013* (2013.01)

(58) Field of Classification Search
CPC ..... F23G 2204/104; F23G 2204/112; F23G 2204/114; F23G 2207/103; F23G 2207/101; F23G 2207/104
USPC ..... 210/747.6, 776, 170.05, 170.09, 170.11, 210/242.3, 923
See application file for complete search history.

(56) References Cited

U.S. PATENT DOCUMENTS

| | | | | |
|---|---|---|---|---|
| 3,695,810 | A | 10/1972 | Heagler | |
| 3,701,430 | A * | 10/1972 | Tuttle | E02B 15/048 210/242.3 |
| 4,308,006 | A * | 12/1981 | Koblanski | E02B 15/042 210/923 |
| 4,669,972 | A * | 6/1987 | Koblanski | F23G 7/05 210/923 |
| 5,057,004 | A * | 10/1991 | McAllister | F23G 7/05 210/923 |
| 5,409,607 | A | 4/1995 | Karlberg | |
| 5,531,890 | A | 7/1996 | Keenan | |
| 5,624,577 | A | 4/1997 | Wehrle et al. | |
| 5,744,046 | A | 4/1998 | Dalmazzone et al. | |
| 6,190,160 | B1 * | 2/2001 | Hibon | F23L 7/007 431/10 |
| 8,366,439 | B2 * | 2/2013 | Ashline | E02B 15/042 431/14 |
| 2003/0141113 | A1 | 7/2003 | Krill | |
| 2008/0039672 | A1 * | 2/2008 | Cornellier | F23G 7/05 588/19 |
| 2011/0042323 | A1 | 2/2011 | Sullivan, II | |
| 2013/0153476 | A1 | 6/2013 | Sorstrom | |
| 2014/0357929 | A1 * | 12/2014 | Nedwed | E02B 15/042 588/321 |
| 2015/0144567 | A1 * | 5/2015 | Nedwed | E02B 15/042 210/747.6 |

OTHER PUBLICATIONS

Buist, I.A. et al, "Subsea Containment: COOSRA Research to Date," Proceedings of the Fifth Arctic and Marine Oilspill Program Technical Seminar, Jun. 15-17, 1982, Edmonton, Alberta, Environment Canada, Ottawa, Ontario, pp. 129-150.

Caron, P., "Atomization Methods for Burning Oil Spills", McGill University, Apr. 1988, Montreal, Quebec, pp. 1-29.

Cooper, D. et al, "One-Step Offshore Collection and Removal: Combining an Oleophilic Skimmer and Floating Burner," AMOP Conference, Jun. 5, 2012, 14 pgs.

Franken, P. et al, "Combustive Management of Oil Spills," Final Report, University of Arizona, 1992, 59 pgs.

Koblanski, J.N., "An Acoustical Method of Burning and Collecting Oil Spills on Cold Open Water Surfaces," Proceedings of the 1983 Oil Spill Conference, Feb. 28-Mar. 3, 1983, pp. 25-28.

Lipski, C., "Study of In-Situ Combustion of Oil Spills," 1986, Environment Canada, Ottawa, Ontario, Report to the Environmental Emergencies Technology Division, 24, 36 pgs.

Nedwed, T. et a l., "One-Step Offshore Collection and Removal: Combining an Oleophilic Skimmer and Floating Burner," 32$^{nd}$ AMOP Technical Seminar on Environmental Contamination and Response, Vancover, British Columbia, Jun. 5 to 7, 2012, 10 pgs.

Nordvik, .B. et al, "Mesoscale In Situ Burn Aeration Tests," MSRC Technical Report 95-017, 1995, Washington, D.C., 7 pgs.

Thompson, C.H. et al, "Combustion: An Oil Spill Mitigation Tool," Report for U.S. Department of Energy, Contract No. EY-76-C-06-1830, 1979, U.S. Department of Energy, Washington, D.C., pp. 561-588.

Zhang, C. et al., "One-Step Offshore Oil Skim and Burn System for Use with Vessels of Opportunity," Clean Gulf Conference, Nov. 13, 2013, 5 pgs.

* cited by examiner

METHOD AND SYSTEM FOR OIL RELEASE MANAGEMENT

CROSS-REFERENCE TO RELATED APPLICATION

This application is the National Stage of International Application No. PCT/US2013/049076, filed Jul. 2, 2013, which claims the benefit of U.S. Provisional Patent Application 61/673,112, filed Jul. 18, 2012, entitled METHOD AND SYSTEM FOR OIL RELEASE MANAGEMENT, the entirety of which is incorporated by reference herein.

FIELD OF THE INVENTION

This invention relates generally to the field of hydrocarbon operations. Specifically, the invention relates to operations for managing oil releases.

BACKGROUND OF THE INVENTION

In the oil and gas industry, hydrocarbons are accessed via a wellbore to provide a fluid flow path to a processing facility. Some of these hydrocarbon resources are located under bodies of water, such as lakes, seas, bays, rivers and/or oceans, while others are located at onshore locations. To transfer hydrocarbons from such locations, a pipeline and/or one or more different vessels (e.g., ship or tanker trucks) may be utilized through various segments from the wellbore and the processing facility.

Additionally, hydrocarbons may be transported from a production region to another region for consumption/processing into hydrocarbon-based products or from one hydrocarbon storage location to another. Transfer of hydrocarbons between such locations often requires one or more different vessels and routes over bodies of water, such as lakes, seas, bays, rivers and/or oceans.

Offshore leaks and/or spills from transfer operations may be problematic due to the hydrocarbons being released into a body of water. Typically, the hydrocarbons may form a slick on the surface of the water, which may be referred to as an oil slick. At the surface, the oil slicks are subjected to wave and currents, which results in the oil slick being distributed over large geographic areas.

These oil slicks may be removed by mechanical and other oil release management techniques. As an example, typical oil release management techniques include in situ burning, oil collection techniques and/or other oil release management techniques. The in situ burning techniques typically utilize the booms that are fire resistant to contain an oil slick. The in situ burning techniques typically include steps, such as containing the oil slick with booms, and igniting the captured oil. The burning of the oil produces large smoke pillars because the oil is not burned efficiently (e.g., portions of the fire being low in oxygen). Further, the inefficient burning results in residuals that may require further treatment.

Another oil release management technique is the oil collection technique. This technique typically involves steps, such as containing the oil slick with booms, utilizing skimmers with the booms to collect and capture the oil and then transporting the oil to an on-shore location or larger vessel for processing. As the oil slicks may be geographically dispersed, different size marine vessels may be utilized together, which may involve different oil management capabilities and coordination between the different marine vessels. Specifically, smaller marine vessels may be utilized to contain and collect the oil and larger marine vessels may offload the smaller vessels to handle the oil collected by the smaller vessels, as well as contain, collect and process the oil obtained by the larger vessel. The coordination and operation of these different sized vessels and transport of the collected water and oil introduces inefficacies into the operations.

Yet another oil release management technique involves the use of floating burners to dispose of the oil slick. For example, U.S. Pat. No. 3,695,810 describes a floating furnace that is used to burn oil residues and emulsions floating on a body of water. The furnace is described as including an insulating material that retains heat within the furnace. As another example, U.S. Pat. No. 3,663,149 describes a burner vessel that collects and burns oil floating on a body of water. The floating burners are capital expensive and fail to provide flexibility in operations.

As the management of hydrocarbon leaks and spills is a time consuming operation, a need exists to enhance operations to manage hydrocarbon releases with enhanced methods and systems. In particular, a need exists to enhance the collection and treatment of oil slicks in a more efficient manner. Further, a need exists for enhancements to floating burners, such that the burning of the hydrocarbons in the oil slick is more efficient and results in less or no residue and soot emissions.

Other related documents include Cooper et al., "One-Step Offshore Collection and Removal: Combining an Oleophilic Skimmer and Floating Burner", AMOP conference (Jun. 6, 2012); Battelle, "Combustion: An oil spill mitigation tool", Report for U.S. Department of Energy, Contract No. EY-76-C-06-1830, U.S. Department of Energy, Washington, D.C. (1979); Belore et al., Air jet atomization and burning of oil slicks, Proceedings of the Thirteenth Arctic and Marine Oilspill Program Technical Seminar, June 6-8, Edmonton, Alberta. Environment Canada, Ottawa, Ontario, pp. 289-304 (1990); Buist et al., Sub-sea containment: COOSRA research to date. Proceedings of the Fifth Arctic and Marine Oilspill Program Technical Seminar, June 15-17, Edmonton, Alberta. Environment Canada, Ottawa, Ontario. pp. 129-150 (1982); Caron, P. (Department of Civil Engineering and Applied Mechanics), Atomization methods for burning oil spills, McGill University, Montreal, Quebec. 29 (1988); Franken et al., "Combustive management of oil spills—Final report", University of Arizona (1992); Koblanski, J.N., "An acoustical method of burning and collecting oil spills on cold open water surfaces", Proceedings of the 1983 Oil Spill Conference, Feb. 28-Mar. 3, 1983; Lipski, C., "Study of in situ combustion of oil spills", Environment Canada, Ottawa, Ontario, Report to the Environmental Emergencies Technology Division, 24 (1986.); and Nordvik et al., "Mesoscale In Situ Burn Aeration Tests", MSRC Technical Report 95-017, Washington, D.C. (1995).

SUMMARY OF THE INVENTION

In one embodiment, a method for managing a hydrocarbon (e.g., oil) release with skimmer and a floating burner is described. The method comprises: towing at least one boom, at least one floating burner and at least one skimmer from a marine vessel through a body of water; containing oil in the body of water within the at least one boom; capturing a fluid within the boom via the at least one skimmer; passing the captured fluid to the at least one floating burner; and combusting at least a portion of the captured fluid via the at least one floating burner.

In one or more embodiments, a system for managing an oil release is described. The system includes a marine vessel; at least one boom configured to be towed from the marine vessel and to contain oil within the boom when being towed; at least one skimmer configured to capture fluid; and at least one floating burner coupled to at least one skimmer and configured to be towed from the marine vessel, receive the captured fluid from the at least one skimmer and combust the captured fluid. The at least one floating burner may comprise a burner section that comprises: stack; a reservoir tank; coupled to the stack with an air gap disposed between the reservoir tank and the stack; a reservoir cup disposed within the reservoir tank and configured to flow fluids from the rim of the reservoir cup into the reservoir tank; an air injection line disposed in the reservoir cup and configured to provide air in a direction toward the stack; and a captured fluid injection line configured to provide captured fluid from the skimmer into reservoir cup; and a floatation section coupled to the burner section and configured to maintain the stack, reservoir cup and reservoir tank above the surface of a body of water. Further, the air injection line may be configured to provide air into the reservoir tank in a direction toward the stack. Also, the air injection line may be configured to be below the captured fluid level in the reservoir cup In other embodiments, various components may be utilized. For example, the at least one skimmer may be an oleophilic skimmer. The captured fluid may comprise at least 50 volume percent hydrocarbons; at least 80 volume percent hydrocarbons; at least 90 volume percent hydrocarbons; at least 99 volume percent hydrocarbons. The system may also include an oxygen sensor to measure the oxygen content of the at least one floating burner, a temperature sensor to measure the temperature of the at least one floating burner and/or a carbon dioxide sensor to measure the carbon dioxide content of the at least one floating burner.

Further, the method may include various aspects. For example, the method may include treating the captured fluid with a demulsifying fluid prior to passing the captured fluid to the at least one floating burner; heating the captured oil prior to combusting the at least the portion of the captured oil; injecting air from an air compressor into the at least one floating burner; and injecting a combustible fluid (e.g., methane, diesel, gasoline, marine fuel oil, liquefied petroleum gas (LPG) or propane and/or butane) into the at least one floating burner. Also, the at least one skimmer may be configured to: pass an oil attracting material through the body of water; move the oil-attracting material from the body of water into a skimmer body; and remove the captured fluid from the oil-attracting material. The method may also include managing the hydrocarbon-to-air ratio of the at least one floating burner, adjusting the amount of air injected into the at least one floating burner and/or adjusting the amount of methane, diesel, gasoline, marine fuel oil, LPG or propane and/or butane injected into the at least one floating burner.

The system and method may also include various embodiments of different configurations. For example, the method may include towing a first boom, a first floating burner and a first skimmer from a first side of the marine vessel and towing a second boom, a second floating burner and a second skimmer from a second side of the marine vessel, wherein the second side is opposite the first side. Further, the method may include towing a first boom and a first skimmer from a first side of the marine vessel; towing a second boom and a second skimmer from a second side of the marine vessel, wherein the second side is opposite the first side; and towing a floating burner disposed adjacent to the first boom and the second boom.

BRIEF DESCRIPTION OF THE DRAWINGS

The foregoing and other advantages of the present disclosure may become apparent upon reviewing the following detailed description and drawings of non-limiting examples of embodiments.

DETAILED DESCRIPTION OF THE PREFERRED EMBODIMENTS

Figure 1:
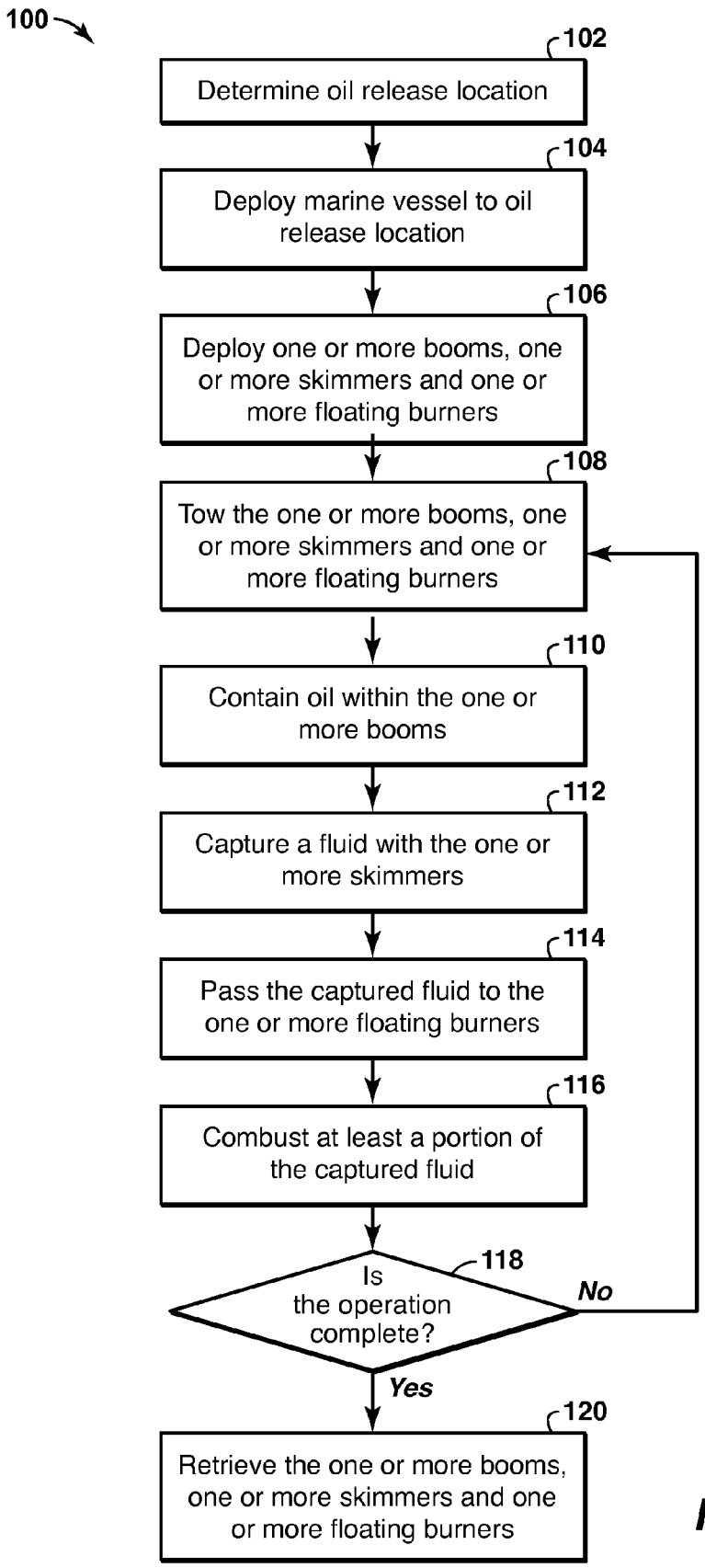
FIG. 1 is a flow chart for implementing a method for managing an oil release in accordance with an exemplary embodiment of the present techniques.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

The oil release management system of the present techniques may be utilized to perform in situ burning of an oil slick without the need for fire-resistant booms and allows deployment from any sized marine vessel, such as vessels of opportunity (e.g., fishing boats, shrimping boats, etc.) by utilizing skimmers combined with a floating burner. That is, the oil release management process may provide a one-step skim and burn system. Indeed, vessels of opportunity may become more effective oil spill responders because the number of vessels is larger compared to dedicated containment and recovery systems and the use of these vessels may eliminate the time-consuming and inefficient steps of storing, transferring, and disposing of recovered oil-water mixtures. The present techniques utilize certain skimmers (e.g., properly operated oleophilic skimmer) that do not entrain much water, such that the recovered fluid could be immediately burned. As such, the present technique may be utilized to in situ replace conventional booming and skimming operations. Further, the burner can be designed to control the air-oil ratio that provides enhancements to the burn rate and combustion efficiency (reduced smoke) compared to in situ burning using fire-resistant booms. The method may even be utilized for emulsified oil through the use of in situ treatment of the collected oil with emulsion breakers to reduce the emulsion water content to a combustible range.

In one embodiment, the oil release management system may include a marine vessel that may be utilized to pull one or more booms, one or more skimmers and one or more floating burners. The booms may be utilized to contain the oil, while the skimmers may be utilized to capture the contained oil along with other fluids. The captured oil may be conveyed from the skimmer to the floating burner. This system may also include various measurement components (e.g., sensors), control devices (e.g., valves) and a process control unit, which are utilized to manage the process. The measurement components may monitor the amount of oil being collected, the hydrocarbon-to-air ratio in the burner, oxygen ($O_2$) levels, carbon dioxide ($CO_2$) levels and temperature, for example.

In certain embodiments of the present techniques, oleophilic skimmers are utilized to enhance the oil release management process. Oleophilic skimmers recover roughly 90% oil and 10% water, whereas other skimmers recover 10% oil and 90% water. Thus, oleophilic skimmers recover a fluid that may be utilized in a combustion process, as opposed to other skimmers, which have a higher water content in the captured fluid. Also, these skimmers may be utilized to recover a broader range of oils, such as emulsified oils and/or oils having variable viscosities. Beneficially, the use of an oleophilic skimmer combined with a floating burner enhances the operation of the oil spill response process by providing removal of oil from the marine environment by the marine vessel that captures the oil. That is, a vessel of opportunity may be equipped with this oil release management system, which provides access to a large fleet of oil spill response vessels.

Further, in one or more embodiments, additional components may be utilized to further enhance the process. For example, the oil release management system may include an air compressor and nozzle system that may be utilized to control the air-fuel ratio for the floating burner. This air compressor may be utilized to provide a proper air-fuel ratio for the floating burner, which may limit the production of black smoke and soot that may result from inefficient burning of the oil. Also, the floating burner may be configured to combust oil at rates that substantially match those recovered by one or more of the oleophilic skimmers. This operation may include measurement components, control units and a process control unit, as noted above, that manages the process in an enhanced manner to efficiently combust the recovered fluid (e.g., with less smoke emitted and minimal residue than the oil could be burned in situ on water). Further still, the oil release management system may include a heat exchanger to heat the captured fluid (e.g., oil and other captured fluids) prior to combustion. Various aspects of the present techniques are described further in FIGS. 1 to 8.

FIG. 1 is a flow chart 100 for implementing a method for managing an oil release in accordance with an exemplary embodiment of the present techniques. This flow chart 100 includes a preparation and deployment stage, which includes blocks 102, 104 and 106, followed by an oil recovery stage, which includes blocks 108, 110, 112 114, 116 and 118, and followed by a retrieval stage, which includes block 120.

The process begins with the preparation and deployment stage, which determines the locations of an oil release and deploying the booms at those locations. At block 102, the oil release location is determined. The determination of the oil release location may include other vessels, such as airborne vessels (e.g., helicopter airplanes, and/or Satellites and unmanned airborne vehicles) and/or other marine vessels that visually inspect the body of water for indications of an oil slick. The determination may also include modeling and/or designing a distribution for multiple marine vessels to cover certain regions of the body of water. Then, the marine vessel may be deployed to the oil release location, as shown in block 104. The marine vessel may be deployed by operating its motor to travel to the oil release location, be transported via another vessel. At block 106, the one or more booms, one or more skimmers, and one or more floating burners may be deployed from the marine vessel. This determination of the configuration of the one or more booms, one or more skimmers, and one or more floating burners along with any other equipment may depend on the thickness of the oil slick, the dimensions of the oil slick, and/or direction and magnitude of the current, wind or waves. Exemplary configurations are discussed further below in FIGS. 2 and 3. Also, the deployment may also include configuring one or more measurement components and/or a process control unit to manage the oil release management system.

After the preparation and deployment stage, the oil recovery stage is performed, as noted in blocks 108, 110, 112, 114, 116 and 118. At block 108, the marine vessel tows the one or more booms, one or more skimmers, and one or more floating burners deployed from the marine vessel. The speed of the towing and other variations may be adjusted subject to the deployed configuration and may depend on the thickness of the oil slick, the dimensions of the oil slick, and/or direction and magnitude of the current, wind or waves. At block 110, the oil is contained within the one or more booms. The oil, which is typically disposed at or near the surface of the water may be hindered from passing external to the containment region formed by the booms because of the boom structure and operation. Then, at block 112, fluid within the booms is captured by the one or more skimmers. The skimmers may include oleophilic skimmers, as noted above, and/or in certain embodiments may include weir or suction skimmers. The skimmers may include an oil-attracting material, which may include belts, disks, mop chains, brushes or the like that are utilized to remove oil from the surface of the body of water. The material utilized for the skimmer may include steel, aluminum, and general-use plastics, and the other suitable materials. The capturing of the fluid may include passing the oil attracting material (e.g., oleophilic material) through the body of water; moving the oil-attracting material from the body of water into a skimmer body or containment tank; and removing the captured fluid from the oil-attracting material (e.g., squeezing and/or scrapping the fluid from the oil-attracting material). The captured fluid may include emulsified oil and/or a fluid having composition of at least 50 volume percent hydrocarbons, at least 70 volume percent hydrocarbons, at least 80 volume percent hydrocarbons, at least 90 volume percent hydrocarbons, at least 95 volume percent hydrocarbons, or 99 volume percent hydrocarbons while the remaining fluid is predominately water (e.g., the composition of the fluid in the body of water, and/or more specifically the fluid in the body of water near the oil slick).

Once the fluid is captured, the captured fluid is then passed to the one or more floating burners, as shown in block 114. The passing of the captured fluid to the one or more burners may include pumping the fluid from the skimmer to the floating burner. The method may also include adjusting the hydrocarbon content of the captured fluid and/or the temperature of the captured fluid. For example, the process may also include treating the captured fluid with a demulsifying fluid prior to passing the captured fluid to the at least one floating burner. In particular, a demulsifying fluid may be combined with the captured fluid in the skimmer. Also, the process may include heating the captured oil through a heat exchanger prior to combusting the at least the portion of the captured oil. The heat exchanger may be a separate unit along the flow path and/or may be integrated with the burner. As a specific example, the stack of the burner may include a fluid passageway that maintain the captured fluid separate from the combustion products, and utilized indirect heat to heat the captured fluids. Then, at block 116, at least a portion of the captured fluid is combusted. The combustion of the captured fluid may include injecting air from an air compressor into the at least one floating burner and/or injecting methane or another combustible fluid (e.g., diesel, gasoline, marine fuel oil, LPG or propane and/or butane) into the at least one floating burner. The combustion process may further manage the hydrocarbon-to-air ratio of the at least one floating burner, which may involve measuring the oxygen content of the at least one floating burner via an oxygen sensor, measuring the temperature of the at least one floating burner via a temperature sensor, measuring the carbon dioxide content of the at least one floating burner via a carbon dioxide sensor, adjusting the amount of air injected into the at least one floating burner, and/or adjusting the amount of a combustible fluid (e.g., combustible fluid is methane, diesel, gasoline, marine fuel oil LPG or propane and/or butane) injected into the at least one floating burner. Then, a determination is made whether the operation is complete, as shown in block 118. This determination may include visual inspection of the body of water within the boom, analyzing one or more samples from the body of water within the boom, and/or other operation concerns. If the operations are not complete, the process returns to block 108.

However, if the operations are complete, then the one or more booms, one or more skimmers, and one or more floating burners are retrieved as shown in block 120. The retrieval of the one or more booms, one or more skimmers, and one or more floating burners may include recapturing the one or more booms, one or more skimmers, and one or more floating burners, cleaning the one or more booms, one or more skimmers, and one or more floating burners from any oil or other residues and transporting the one or more booms, one or more skimmers, and one or more floating burners to another marine vessel or on-shore location.

Beneficially, this configuration provides flexibility and enhances the oil release management process. The system is compact and portable, which may be deployable from vessels of opportunity or other larger marine vessels. Accordingly, a large number of marine vessels may be deployed and utilized to address oil slicks (e.g., large oil spills that have degraded into many small slicks). Also, this process manages the combustion to control the hydrocarbon-to-air ratio, which is not possible with other techniques, and reduces or eliminates the amount of unburned residual oil and soot emissions, which results from an in situ burn using fire-resistant booms. This process does not require transporting captured oil from one vessel to another, delays from such operations and/or even the use of fire-resistant booms. Further, the floating burners provide greater control over the combustion process, as the floating burner may be terminated, while the in-situ burning may not be controllable once started. Accordingly, this process provides an enhancement over conventional processes.

Figure 2:
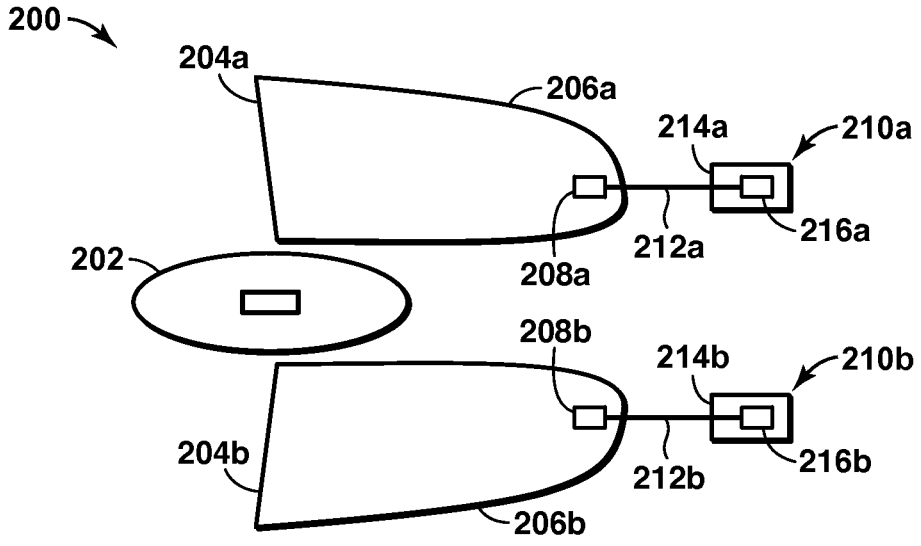
FIG. 2 is a diagram of an oil release management system in accordance with an exemplary embodiment of the present techniques.
Figure 3:
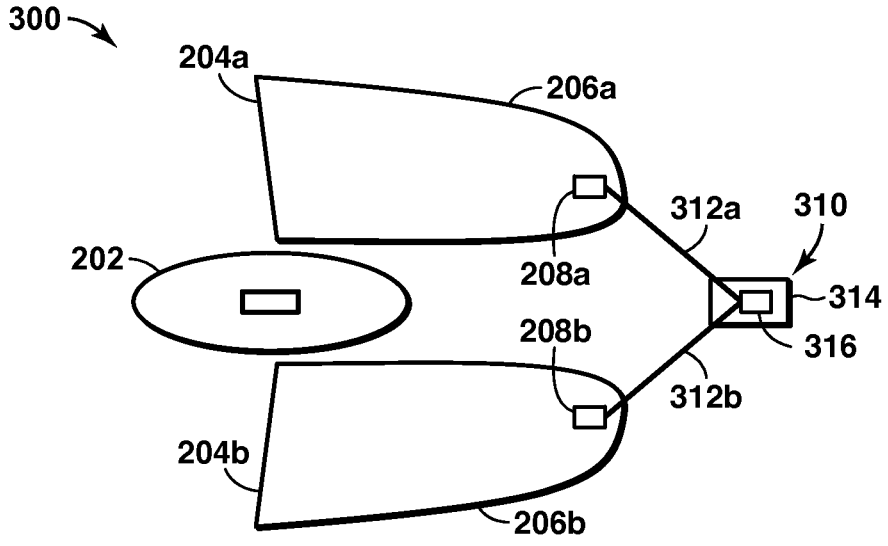
FIG. 3 is a diagram of another oil release management system in accordance with an exemplary embodiment of the present techniques.

The specific operations of the method for managing an oil release may include various different configurations. Exemplary configurations of a marine vessel are shown in FIGS. 2 and 3. FIG. 2 is a diagram of an oil release management system 200 in accordance with an exemplary embodiment of the present techniques. The oil release management system 200 may include a marine vessel 202 that has a first outrigger 204*a* and a second outrigger 204*b*. The marine vessel 202 may be a vessel of opportunity, such as fishing boat, shrimping boat and/or other suitable marine vessel. The marine vessel 202 may have a length greater than 15 feet, greater than 25 feet, greater than 35 feet and less than 75 feet, less than 90 feet, less than 110 feet or less than 120 feet. In other embodiments, the marine vessel 202 may have a length greater than 15 feet, greater than 25 feet, greater than 35, feet greater than 75 feet, greater than 90 feet, greater than 110 feet or greater than 120 feet. The outriggers 204*a* and 204*b* may be securely fastened to the marine vessel 202 and extend from different sides of the marine vessel 202 over the body of water on opposite sides of the marine vessel 202. The outriggers 204*a* and 204*b* may be adjustable in length and/or angle to provide flexibility in the equipment being towed from the marine vessel 202. The marine vessel 202 may tow equipment via the outriggers 204*a* and 204*b*. In particular, the first outrigger 204*a* is utilized to tow the first boom 206*a*, the first skimmer 208*a*, the first captured fluid tubing 212*a*, and the first floating burner 210*a*, while the second outrigger 204*b* is utilized to tow the second boom 206*b*, the second skimmer 208*b*, the second captured fluid tubing 212*b*, and the second floating burner 210*b*.

The booms 206*a* and 206*b* may include various segments that are connected together to manage the hydrocarbons floating on the surface of the body of water (e.g., the oil slick). For example, the booms 206*a* and 206*b* may include a floating section that has a portion partially submerged in the water and a portion that extends out of the water, a skirt and ballast section that is located in the water, and/or may include an anchor section utilized to secure the boom in a relatively fixed location or a fixed orientation. The floating section is designed to maintain hydrocarbons from entraining over the boom, and the skirt and ballast section is designed to maintain hydrocarbons from entraining under the boom. The floating section and the skirt and ballast section are utilized to either contain or divert the hydrocarbons. The anchor section may include one or more anchors and associated lines to secure the anchors to the skirt and ballast section. If more than one boom is used, each boom may include these different sections.

The skimmers 208*a* and 208*b* may be utilized in one of the areas formed by the booms 206*a* and 206*b*, respectively. The skimmers 208*a* and 208*b* may be utilized to remove hydrocarbons (e.g., oil) floating on the surface of the body of water (e.g., the oil slick). For example, the skimmers 208*a* and 208*b* may include a housing, a storage tank, floatation member to maintain a portion of the skimmer above the surface of the body of water, captured fluid removal section and a motor. The motor is configured to move an oil-attracting material via belts, disks, mop chains, brushes or the like over or through the body of water, and through the captured fluid removal section, which is configured to remove the captured fluid from the oil-attracting material. The captured fluid may be contained in storage tank or vessel, which may be a portion of the skimmer housing. The skimmer may also include a pump, which is utilized to pump the captured fluid to another location, such as the floating burner or heat exchanger.

The floating incinerators 210*a* and 210*b* may be connected to one of the skimmers 208*a* and 208*b* via the captured fluid tubing 212*a* or 212*b*, which may be a tubing or conduit. The floating burners 210*a* and 210*b* may each include a flotation section 214*a* or 214*b* and a burner section 216*a* or 216*b*. The flotation sections 214*a* and 214*b* are utilized to maintain the burner sections 216*a* and 216*b* above the surface of the body of water and may also be configured to maintain the stability of the burner sections 216*a* and 216*b*. The burner sections 216*a* and 216*b*, which includes a stack and a reservoir tank, are configured to combust the captured fluid. The configuration of the floating burner may include various different variations, and is described further below.

FIG. 3 is a diagram of another oil release management system 300 in accordance with an exemplary embodiment of the present techniques. As the oil release management system 300 may include similar equipment as that used in the system of FIG. 2, the same reference numerals are utilized for simplicity. This system 300 is a variation in the configuration of the system 200 by using a single floating burner 310 to combust the captured fluid from the skimmers 208*a* and 208*b*. In this configuration, the single floating burner 310 may include a burner section 316 disposed on floatation device 314, which operates similar to the floating burners 210*a* and 210*b*, as noted above. However, in this configuration, the first captured fluid tubing 312*a* and the second captured fluid tubing 312*b* provide the captured fluid to the floating burner 310.

Beneficially, this configuration provides certain enhancements over other configurations. For example, the location of the floating burner may be positioned to be in the wake of the propellers from the marine vessel 202, which may reduce wave movement. Further, this configuration also reduces expenses by utilizing a single floating burner to manage different captured fluids from different booms.

In addition, each of these systems 200 and 300 may include additional equipment that may further enhance the process. For example, an air compressor may be utilized with the floating burners 210*a*, 210*b* and 310 to provide air to enhance the combustion process. The air compressor may be located on the marine vessel 202 and/or may be disposed on the floating burners 210*a*, 210*b* and 310. The air compressor may provide air into the stack via one or more nozzles directed at an angle to create a swirling motion within the stack. As another example, a heat exchanger may be utilized with the floating burners 210*a*, 210*b* and 310, skimmers 208*a* and 208*b* and captured fluid tubing 212*a*, 212*b*, 312*a* and 312*b* to heat the captured fluid prior to being provided to the burner section 216*a*, 216*b* and 316. The heat exchanger may be included as one or more channels through the stack, tubing through the internal region formed by the stack, and/or tubing external to the stack. The heat exchanger may also be located adjacent to the stack and utilized diverted combustion products to heat the captured fluid prior to the burner section.

Further, each of these systems 200 and 300 may include additional equipment to manage the operation of the process. For example, the burner section 216*a*, 216*b* and 316 of the floating burner may include one or more openings (e.g., orifices and/or nozzles) for the injection of air, oxygen, methane, hydrogen and/or combustible fluids. In particular, one or more storage tanks of methane, oxygen and/or hydrogen may be coupled to the reservoir tank to inject the methane, oxygen and/or hydrogen through a portion of the captured fluid and/or adjacent to captured fluid to form the flame. Also, an air compressor may be coupled to the reservoir tank to inject air. Any combustible fluid may be used in place of methane, such as diesel, gasoline, marine fuel oil, LPG or propane and/or butane.

To manage the hydrocarbon-to-air ratio of the floating burners 210*a*, 210*b* and 310, one or more measurement components may be utilized along with a process control unit and control units. The measurement components may be utilized to measure the oxygen content of the floating burner via an oxygen sensor, measure the temperature of the floating burner via a temperature sensor; and/or measure the carbon dioxide content of the floating burner via a carbon dioxide sensor. The sensors may communicate the measurements to a process control unit that may provide a notification to an operator to adjust the amount of air, methane, oxygen and/or hydrogen injected into the floating burner and/or transmit a signal to a control device to adjust the amount of air, methane, oxygen and/or hydrogen injected into the floating burner.

As an example, the floating burners 210*a*, 210*b* and 310 may include a process control unit that is utilized to manage the injection of air, methane, oxygen and/or hydrogen injected into the floating burner. The power components may include a battery, wind, wave, and/or solar powered equipment. The different components or modules may be powered from the power component or may include separate power sources for each of the respective components or modules. Also, the different components and modules may also utilize a separate power source as a redundant power supply in certain embodiments.

The communication components may include communication equipment that is utilized with one or more antennas to communicate with one or more of measurement components or other process control units and/or internal components or modules. The communication equipment may utilize technologies, such as radio, cellular, wireless, microwave or satellite communication hardware and software. Also, the communication equipment may include and utilize any of a variety of known protocols to manage the exchange of information (e.g., Ethernet, TCP/IP, and the like). The communication equipment utilized may depend on the specific deployment locations and configuration. For example, if a measurement component and the process control unit are located in close proximate to each other, one form of communication may be utilized (e.g., wireless, radio, or physical connection), while for larger distances a second form of communication (e.g., satellite, or a different one from the first communication type of wireless and radio). In this manner, each measurement component and control unit may each include communication components that operate independently to communicate with the process control unit.

The measurement components may include various modules that provide information relating to operation of the floating burner. For example, the measurement components may include oxygen ($O_2$) and carbon dioxide ($CO_2$) sensors, flow meters, thermocouples and/or temperature sensors, for example. The measurement components may be configured to collect measurement data (e.g., amount of oil being collected, the hydrocarbon-to-air ratio in the burner, oxygen ($O_2$) levels, carbon dioxide ($CO_2$) levels and temperature) and transmit the measured data to the process control unit. These sensors may be disposed at various locations on the floating burner. For example, the thermocouples may be attached outside the stack and/or internal to the stack to obtain measurement data. The measurement components may be configured to transmit information within a set time window (e.g., every 1 seconds, 5 seconds, 10 seconds, or even 30 second), transmit information when polled by the process control unit, or transmit information when a threshold has been reached or exceeded (e.g., monitored level is below or above a specified range or operational setting stored in memory).

The process control unit may include a processor, memory, communication components and a set of instructions stored in memory and accessible by the processor. The process control unit may be configured to communicate with the measurement components to obtain measurement data, communicate with control units to adjust flow rates, compare the measurement data to thresholds, calculate adjustments to the control units and communicate operational settings to the control units. Persons skilled in the technical field will readily recognize that in practical applications of the disclosed methodology of managing the operations, it is partially performed on a computer, typically a suitably programmed digital computer.

Certain embodiments of the process control unit, measurement components and control units may relate to an apparatus for performing the operations herein. This apparatus may be specially constructed for the required purposes, or it may comprise a general-purpose computer selectively activated or reconfigured by a computer program stored in the computer (e.g., one or more sets of instructions). Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.)).

Furthermore, as will be apparent to one of ordinary skill in the relevant art, the modules, components, features, attributes, methodologies, and other aspects of the invention can be implemented as software, hardware, firmware or any combination of the three. Of course, wherever a component of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present invention is in no way limited to implementation in any specific operating system or environment.

Further, one or more embodiments may include methods that are performed by executing one or more sets of instructions to perform modeling enhancements in various stages. For example, the method may include executing one or more sets of instructions to perform comparisons between thresholds current statuses or indications along with transmitting data between modules, components and/or sensors.

Figure 4:
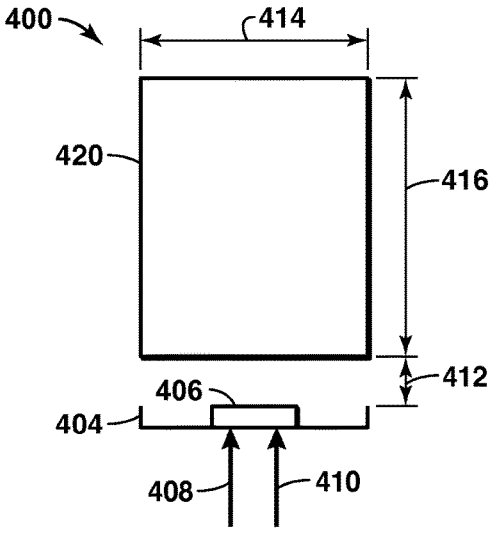
FIG. 4 is a diagram of a burner section in accordance with an exemplary embodiment of the present techniques.
Figure 5:
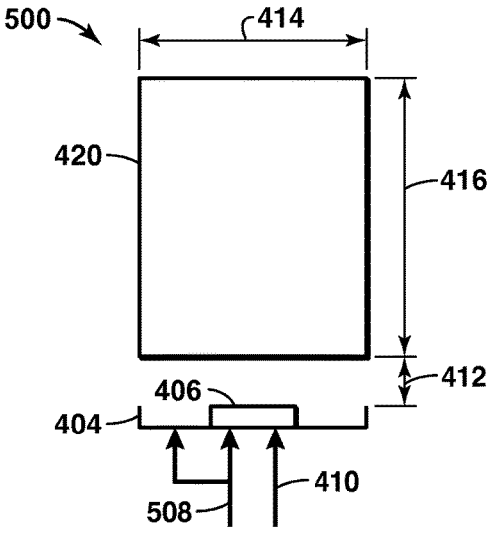
FIG. 5 is a diagram of another burner section in accordance with an exemplary embodiment of the present techniques.

The specific configuration of the floating burner section may include various different configurations. Exemplary configurations of the burner section are shown in FIGS. 4 and 5. FIG. 4 is a diagram of a burner section 400 in accordance with an exemplary embodiment of the present techniques. The burner section 400 may include stack 402, reservoir tank 404, a reservoir cup 406, an air injection line 408 and captured fluid injection line 410. The stack 402 may include a metal structure having an open internal region to provide control the flame generated from the combustion of the captured fluid. The diameter of the stack 402, which is indicated by the line 414, may be in the range of 12 inches to 70 inches or in the range of 18 inches to 36 inches. The height of the stack 402, which is indicated by the line 416, may be in the range of 12 inches to 10 feet, in the range of 18 inches to 8 feet, or in the range of 3 feet to 6 feet.

Below the stack 402, the reservoir tank 404 and reservoir cup 406 are disposed. The gap or distance between the stack 402 and the top of the reservoir tank 404 and reservoir cup 406 may be managed to provide for air flow into the stack 402 to enhance the combustion process. In one embodiment, the reservoir cup 406 may be configured to have over flow into the reservoir tank 404 to manage the captured fluid aspirated by the air injected into the reservoir cup 406. The height of the gap 412 may be adjusted based on the composition of the captured fluid, the cross sectional area of the stack 402, and/or other combustion factors. In particular, the surface area of the gap may be within a range of 30% to 50% of the cross sectional area of the stack 402. In certain embodiment, the height of the gap may be in the 1 centimeter to 30 centimeters, in the range of 2 centimeters to 15 centimeters, in the range of 3 centimeters to 10 centimeters. Also, additional air, oxygen, hydrogen and/or combustible fluid lines may also be provided via this gap 412 or from below the reservoir cup 406.

To supply the air and captured fluid to the reservoir tank 404 and reservoir cup 406, the air injection line 408 and captured fluid injection line 410 are utilized. The air injection line 408 may be coupled to an air compressor and utilized to provide the air pressure sufficient to aspirate the captured oil within the reservoir cup 406. The air may be injected at a pressure in the range of 1 psig to 100 psig or in the range of 10 psig to 50 psig. The captured fluid injection line 410 may be a conduit or tubing coupled to the captured fluid tubing 212*a*, 212*b*, 312*a* and 312*b* or may be a portion of the captured fluid tubing 212*a*, 212*b*, 312*a* and 312*b*. The captured fluid injection line 410 may be coupled to a pump line from the skimmer and utilized to provide the captured fluid at sufficient pressure to intermingle the captured fluid with air within the reservoir cup 406. In other embodiments, the captured fluid injection line 410 may be utilized to provide the captured fluid at a sufficient pressure to enter the reservoir cup 406, and rely upon the air injected into the reservoir cup 406 to facilitate the combustion mixing.

FIG. 4 is a diagram of a burner section 500 in accordance with an exemplary embodiment of the present techniques. As the burner section 500 may include similar equipment as that used in the burner section of FIG. 4, the same reference numerals are utilized for simplicity. However, in this configuration, the air injection line 508 is provided to the reservoir tank 404 and reservoir cup 406. In this manner, the hydrocarbon-to-air ratio may be managed at various locations to further enhance the combustion of the captured fluid. Also, in this configuration, the air pressure provided to the reservoir tank 404 and reservoir cup 406 may be the substantially the same or may be different. This provides flexibility to the burner section in managing the combustion process.

In addition, each of these burner sections 400 and 500 may include additional configurations of equipment that may further enhance the process. For example, the air injected into the reservoir tank 404 or reservoir cup 406 may include a conduit with openings for the air to flow through the captured fluid. The conduit may include a substantially circular conduit, parallel conduits, portion of a circular conduit, for example. The conduit may be disposed below the surface of the reservoir tank 404 or reservoir cup 406 (e.g., the surface is the fluid level when the reservoir tank 404 or reservoir cup 406 is full of fluid) or even at a specific depth below the surface of reservoir tank 404 or reservoir cup 406. The specific depth and configuration of the openings may be configured to provide the air flow through the captured fluid to provide sufficient aspiration. In another embodiment, the air injected into the reservoir tank 404 or reservoir cup 406 may pass through one or more nozzles that pass through the reservoir tank 404 or reservoir cup 406. The nozzles may be distributed into a specific pattern and/or may disposed below the surface of the reservoir tank 404 or reservoir cup 406 or even at a specific depth below the surface of reservoir tank 404 or reservoir cup 406. As with the conduits, the specific depth and configuration of the nozzles may be configured to provide the air flow through the captured fluid to provide sufficient aspiration.

As part of the review of the different burner configurations, various tests were performed utilizing a bench-scale model of a floating burner. A number of parameters including stack height, air jet angle, air volume, air velocity, air jet height above surface, and gap height were identified for evaluation. The tests were performed using similar conditions. The general procedure for the tests involved introducing a specific quantity of oil into the burn ring at the bottom, igniting the burner to begin the test, venting of the smoke was performed, and observations were recorded for each of the tests. The tests are described in Cooper et al., "One-Step Offshore Collection and Removal: Combining an Oleophilic Skimmer and Floating Burner", AMOP conference (Jun. 6, 2012), which is incorporated by reference herein.

As part of the tests, compressed air was introduced via stainless steel rods with a hollow core approximately ⅛ inch (3 millimeters) in diameter. The air injection was varied through the tests to provide exit velocities up to 80 m/s. The rods were configured at an angle to the walls to help induce a swirling motion within the stack. A fourth rod was installed low in the middle of the stack to contribute to the atomization of oil during the burn tests. The burner was placed in a test tank for the tests, which included a frame resting on the bottom of the tank. The stack was a commercially available stainless steel, double walled chimney with a refractory lining terminated in a stainless steel gasket to protect the liner, which was configured to have heights of 18 inches and 30 inches for the tests and a cross sectional diameters of 5 inches (13 cm). The stack was secured in a manner to permit the adjustment of the gap between the containment ring encompassing the oil pool and the bottom of the stack, which was varied from 8 mm, 16 mm, and 32 mm. The oil used during the bench scale testing was Endicott.

Figure 6:
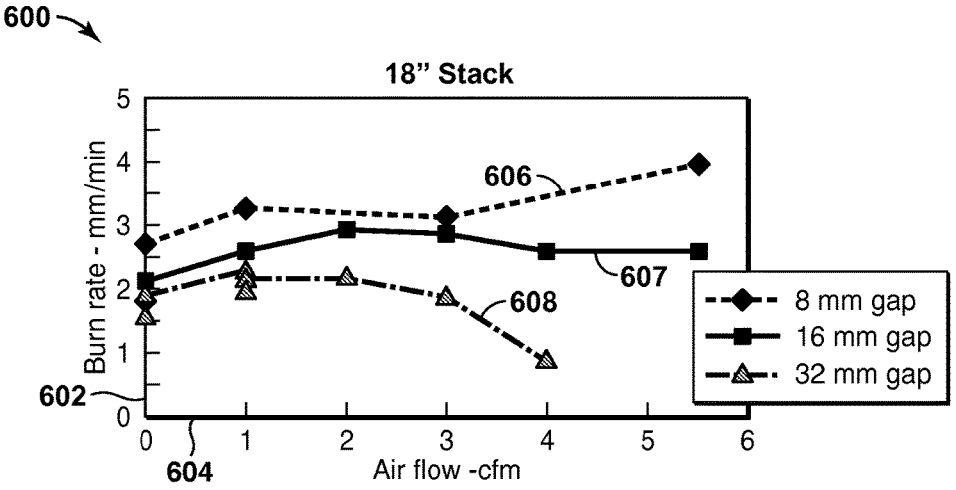
FIGS. 6 to 8 are charts of test results for a burner section in accordance with an exemplary embodiment of the present techniques.
Figure 7:
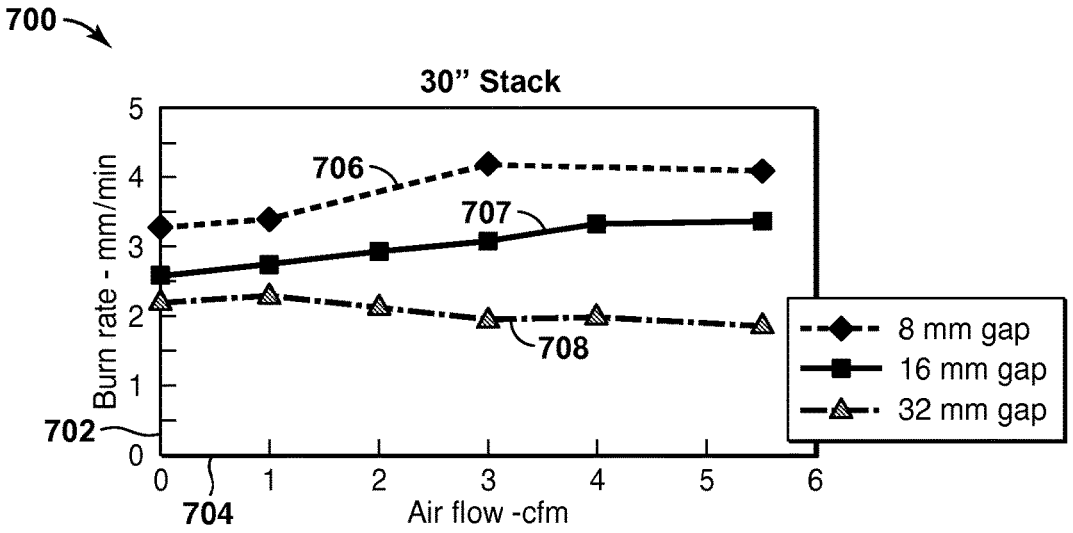
Figure 8:
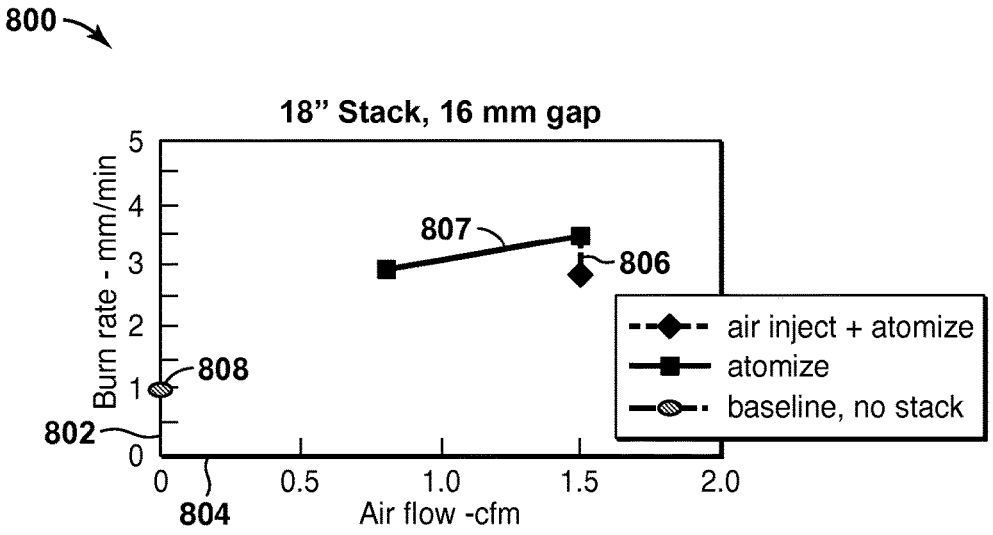

The tests results are provided in FIGS. 6, 7 and 8, which are charts of tests results for a burner section in accordance with an exemplary embodiment of the present techniques. FIG. 6 is a chart 600 of bench results from an 18 inch stack. In this chart 600, the burn rate in millimeters per minute (mm/min) is shown along the axis 602 and the air flow in cubic feet per minute (cfm) is shown along the axis 604. Different responses, such as response 606 for an air gap of 8 mm, response 607 for an air gap of 16 mm and response 608 for an air gap of 32 mm, are provided.

FIG. 7 is a chart 700 of bench results from a 30 inch stack. In this chart 700, the burn rate in millimeters per minute (mm/min) is shown along the axis 702 and the air flow in cubic feet per minute (cfm) is shown along the axis 704. Different responses, such as response 706 for an air gap of 8 mm, response 707 for an air gap of 16 mm and response 708 for an air gap of 32 mm, are provided.

As noted for these stacks, the 30 inch stack provides larger burn rates as compared to the 18 inch stack. Also the 30 inch stack appears to provide a more consistent burn rate for the different air flows as compared to the 18 inch stack. Also, the adjustment of the gap for the different stacks results in improvements in the burn rate. The calculated area of the stack is approximately 126.7 $cm^2$. Accordingly, the initial air gap was selected to be slightly larger than the area of the stack. The reduction of the air gap from this initial air gap setting throttles the air being drawn into the burn area, this results in increased burn rates as the gap is reduced.

FIG. 8 is a chart 800 of bench results from an 18 inch stack with a fixed gap at 16 mm. In this chart 800, the burn rate in millimeters per minute (mm/min) is shown along the axis 802 and the air flow in cubic feet per minute (cfm) is shown along the axis 804. Different responses, such as response 806 for an air injection and atomize, response 807 for an atomize and response 808 for a base line with no stack, are provided. As a result, the injection of air through perimeter nozzles improved the smoke generation and the burn rate.

From these tests, various factors should be considered in operating the burner. First, the burn efficiency was adversely affected as incompletely combusted oil particles splattered from both the stack and the oil pool during the intense burn. Accordingly, the combustion should be adjusted to enhance the combustion process. Second, there were also problems with flare-outs on a couple of runs when the 8 mm gap was used. While the burn reignited almost instantaneously, the air gap may have a lower limit that should be maintained to lessen concerns over controlling the burn under these circumstances.

Based on the bench tests and results in the charts, various mid-scale tests were performed in a tank. In these tests, a skimmer was incorporated into the testing, located adjacent to the burner in the tank, to collect and supply oil to a pump feeding a small stainless steel bowl in the middle and below the stack. The burner section included a supported stack with a 14 inch (36 centimeter (cm)) inner diameter, an outer diameter of 16 inch (41 cm), and a height of the chimney was 48 inches (122 cm). The calculated area of the stack is approximately 993 $cm^2$. Mounted on the inside base of the burner were three stainless steel air injection nozzles, each with an inner diameter of approximately ⅜ inches (9.5 mm) oriented towards the inner walls of the stack. The nozzles were mounted at an angle of approximately 30° from vertical. A stainless steel cup was mounted at the center of the chimney base with inlet piping to allow oil to be introduced as the unit was in operation. A 16 inch (41 cm) burning ring was installed at the waterline to contain oil during the batch and continuous mode tests. In addition, a curved section of conduit with small orifices (e.g., drilled openings) directed toward the stack were utilized in the stainless steel cup.

The test results are shown in Tables 1 and 2, below.

TABLE 1

Meso test results - air gap analysis

| | stack | 8.9 cm gap | 5.1 cm gap | 3.8 cm gap |
|---|---|---|---|---|
| Diameter (inches) | 14 | 16* | 16* | 16* |
| Diameter (cm) | 35.6 | 40.6* | 40.6* | 40.6* |

TABLE 1-continued

| Meso test results - air gap analysis | | | | |
|---|---|---|---|---|
| | stack | 8.9 cm gap | 5.1 cm gap | 3.8 cm gap |
| Area (cm^2) | 993 | 1136 | 651 | 485 |
| Area Ratio | | 1.14 | 0.66 | 0.49 |

*Diameter of burn ring

From the tests, the combustion process appears to progress through different phases, a preliminary burn phase, an intense burn phase and a flare out/extinguishing phase. The preliminary burn phase was the time during the initiation of the fire until flames completely covered the oil pool area and the air injection was being engaged. The intense burn phase was the time from the start of the air injection, which triggered noticeable increases in the flames until a noticeable reduction in flame intensity was detected (usually following a termination of the oil flow feeding the burner assembly). The flare out/extinguishing phase was the time observed from the noticeable reduction in flame intensity until the flames in the oil pool reduced below 25% coverage. When these stages are taken into account, the data can be broken down into the distinct phases and the burn rates can be recalculated, as shown in Table 3 below.

TABLE 2

| Field Run Results | | | | | | | | | |
|---|---|---|---|---|---|---|---|---|---|
| MESO SCALE TEST | Total Air Rate (cfm) | Air Nozzles | Air Gap (cm) | Initial Oil/oil pumped (mL) | Final Oil (mL) | Net Oil (mL) | Burn Time (sec) | % Oil Consumed | Overall consumption rate* (mm/min) |
| 1 | 27 | 3 + 0 | 3.8 | 1300 | 60 | 1240 | 187 | 95.4% | 3.1 |
| 2 | 27 | 3 + 0 | 8.9 | 1300 | 139 | 1162 | 296 | 89.3% | 1.9 |
| 3 | 36 | 3 + 3 | 8.9 | 1300 | 112 | 1188 | 289 | 91.4% | 1.9 |
| 4 | 36 | 3 + 3 | 5.1 | 1298 | 95 | 1203 | 222 | 92.7% | 2.5 |
| 5 | 36 | 3 + 3 | 3.8 | 1348 | 51 | 1297 | 222 | 96.2% | 2.7 |
| 6 | 36 | 3 + 3 | 3.8 | 3600 | 5 | 3595 | 275 | 99.9% | 6.1 |
| 7 | 36 | 3 + 3 | 3.8 | 2430 | 5 | 2425 | 198 | 99.8% | 5.7 |
| 8 | 36 | 3 + 3 | 3.8 | 9550 | 5 | 9545 | 230 | 99.9% | 19.2 |
| 9 | 36 | 3 + 3 | 3.8 | 14160 | 5 | 14155 | 498 | 100.0% | 13.2 |
| 10 | 36 | 3 + 3 | 3.8 | 8250 | 46 | 8204 | 276 | 99.4% | 13.8 |
| 11 | — | 3 + 6 | 3.8 | — | — | — | — | — | — |
| 12 | 39 | 3 + 6 | 3.8 | 5760 | 5 | 5755 | 411 | 99.9% | 6.5 |

*the normal burn rate for a 40 cm diameter pool of crude oil on water is 1 mm/min Similar to the previous results from the charts of FIGS. 6 and 7, the air gap impacts the burn rate, as noted from Table 2. The air gap of 8.9 cm is slightly larger than the area of the stack, while the other air gaps are smaller and throttle the air flow from outside the stack, which results in increased velocities. The air gap heights translate into defined areas and consequent area ratios when compared to the cross sectional area of the stack used in the burn tests as shown in Table 2. An analysis of the data shows that the best results were obtained when the oil was pumped to the burner. Pumping the oil placed it directly around the atomizing nozzles which helped accelerate combustion.

TABLE 3

| Field Run Results - Phased | | | | | | | | | |
|---|---|---|---|---|---|---|---|---|---|
| MESO | Preliminary burn | | | Intense burn | | | Flare out/Extinguishing | | |
| SCALE TEST | preflare time (min) | Preflare rate (mm/min) | Preflare quantity (mL) | Flare time (min) | Flare rate* (mm/min) | Flare quantity (mL) | Post flare time (min) | Post flare rate (mm/min) | Post flare quantity (mL) |
| 1 | 1:34 | 1.5 | 305 | 1:18 | 5.2 | 871 | 0:15 | 2 | 65 |
| 2 | 0:56 | 1.5 | 182 | 3:45 | 1.9 | 915 | 0:15 | 2 | 65 |
| 3 | 1:07 | 1.5 | 217 | 3:39 | 2.0 | 958 | 0:03 | 2 | 13 |
| 4 | 1:17 | 1.5 | 250 | 2:08 | 3.2 | 880 | 0:17 | 2 | 73 |
| 5 | 1:17 | 1.5 | 250 | 2:06 | 3.6 | 978 | 0:16 | 2 | 69 |
| 6 | 1:23 | 1.5 | 269 | 2:57 | 8.5 | 3261 | 0:15 | 2 | 65 |
| 7 | 0:58 | 1.5 | 188 | 2:20 | 7.4 | 2237 | 0:00 | 2 | 0 |
| 8 | 1:03 | 1.5 | 204 | 3:07 | 23.0 | 9311 | 0:07 | 2 | 30 |
| 9 | 0:53 | 1.5 | 172 | 7:25 | 14.5 | 13944 | 0:09 | 2 | 39 |
| 10 | 0:53 | 1.5 | 172 | 3:38 | 17.0 | 8011 | 0:05 | 2 | 22 |

TABLE 3-continued

| Field Run Results - Phased | | | | | | | | | |
|---|---|---|---|---|---|---|---|---|---|
| MESO | Preliminary burn | | | Intense burn | | | Flare out/Extinguishing | | |
| SCALE TEST | preflare time (min) | Preflare rate (mm/min) | Preflare quantity (mL) | Flare time (min) | Flare rate* (mm/min) | Flare quantity (mL) | Post flare time (min) | Post flare rate (mm/min) | Post flare quantity (mL) |
| 11 | — | — | — | — | — | — | — | — | — |
| 12 | 1:04 | 1.5 | 207 | 5:20 | 7.9 | 5491 | 0:15 | 2 | 56 |

*the normal burn rate for a 40 cm diameter pool of crude oil on water is 1 mm/min The test results indicate that the system operates in an enhanced manner, which may utilize an oleophilic skimmer and a floating burner. The processing rate of the system had consumed oil at a rate in excess of 20 mm per minute for certain tests. When the 20 mm per minute rate is applied to a 1.83 meter (m) (6 ft) diameter burn, oil is consumed at a volumetric rate of 3.16 $m^3$/hour (hr) (approximately 20 bbl barrels/hr).

As further examples, potential applications are described for two different oil slicks. In the first example, if we assume a representative slick thickness of 1 mm, an advancing rate of 0.39 m/s (0.75 knots), then the quantity of oil that can be swept per 3.05 m (10 feet (ft)) of swath width of containment boom is 4.28 $m^3$/hr (26.9 bbl/hr) at 100% coverage. If the coverage decreases to 50%, then the collection rate drops to 2.14 $m^3$/hr (13.5 bbl/hr), or even 1.07 $m^3$/hr (6.7 bbl/hr) for 25% oil coverage. Dedicated vessels with the ability to collect oil using containment booms with large swaths are likely to overwhelm the 1.83 m (6 ft) diameter burner section for this example. If greater oil burning capacity is required, then the burner system may have to be larger. There are, however, practical limitations from a stability standpoint to the height of the floating stack and a matrix of smaller burners should be considered to resolve an increase in capacity. Accordingly, certain embodiments should incorporate multiple shorter burner systems (stacks) into one floating platform should provide the opportunity to create a design that is more stable than a single, large unit.

As a second example, a vessel of opportunity is used with a boom length of 30.5 m (100 ft) and a swath of approximately 9.14 m (30 ft). The area of the oil pocket encompasses the back third of the linear distance of the "U-shape" of the boom. Using an elliptical shape as an approximation for the shape of the boom, the oil segment would cover an area of approximately 20 $m^2$ (215 $ft^2$). Assuming an average depth of oil in the pocket of 25 cm (10 inches), the volume collected would amount to 5 $m^3$ or 31.4 bbl. If the vessel of opportunity was travelling at a speed of 0.26 m/s (0.5 knots) then the oil collection rate is 8.42 $m^3$/hr and it takes over half of an hour (36 minutes) to fill the back ⅓ of the boom. This quantity of oil is consumed in over one and half hours (1 hour, 35 minutes) with the 6 foot scaled burner system. If coverage is less than 100%, collection times are extended as shown below in Table 4:

TABLE 4

| Estimated Full Scale Collection and Burn Times | | | | | | |
|---|---|---|---|---|---|---|
| COVERAGE ($m^3$) | Oil Collection Rate ($m^3$/hr) | Burn Rate ($m^3$/hr) | Storage Reserve ($m^3$) | Collection Time Limitation (time to fill) | Collection Time Limitation (time to fill while burning) | Time to Burn Once Filled |
| 100% | 8.42 | 3.16 | 5 | 0:36 | 0:57 | 1:35 |
| 50% | 4.21 | 3.16 | 5 | 1:11 | 4:46 | 1:35 |
| 25% | 2.10 | 3.16 | 5 | 2:23 | Not limited | 1:35 |

The second example illustrates that a 1.83 m (6 ft) burner configuration could help a vessel of opportunity by increasing the time it is available to collect oil in both a continuously operated and batch mode.

The skimmer and burner combination has the ability to burn oil from water surfaces without generating significant smoke plumes or residual oil. This concept may enable greater use of in situ burning for marine and freshwater oil spills. In fact, air injection through nozzles pointed upwards at the base of the stack can produce a dramatic improvement in reducing smoke produced during a burn. These air injection nozzles may be angled to result in a swirling motion, which may further enhance the mixing of hydrocarbons and oxygen. Also, while the height of the stack enhances the burn rate, the injection of fast moving air may reduce its benefits. Thus, smaller stacks may be utilized which may be more manageable for stability concerns.

One or more of the following embodiments in the following paragraphs may be utilized with the processes, apparatus, and systems, provided above. These embodiments include:

1. A method for managing an oil release, comprising: towing at least one boom, at least one floating burner and at least one skimmer from a marine vessel through a body of water; containing oil on the body of water within the at least one boom; capturing a fluid within the boom via the at least one skimmer; passing the captured fluid to the at least one floating burner; and combusting the at least the portion of the captured fluid via the at least one floating burner.
2. The method of paragraph 1, wherein the at least one skimmer is an oleophilic skimmer.
3. The method of any one of paragraph 1 to 2, wherein capturing the fluid within the boom via the at least one skimmer comprises: passing an oil attracting material through the body of water; moving the oil-attracting material from the body of water into a skimmer body; and removing the captured fluid from the oil-attracting material.

4. The method of any one of paragraphs 1 to 3, wherein the captured fluid comprises at least 50 volume percent hydrocarbons or at least 80 volume percent hydrocarbons.
5. The method of any one of paragraphs 1 to 3, wherein the captured fluid comprises at least 90 volume percent hydrocarbons.
6. The method of any one of paragraphs 1 to 3, wherein the captured fluid comprises 99 volume percent hydrocarbons.
7. The method of any one of paragraphs 1 to 3, comprising treating the captured fluid with a demulsifying fluid prior to passing the captured fluid to the at least one floating burner.
8. The method of any one of paragraphs 1 to 7, wherein passing the captured oil to the at least one floating burner comprises heating the captured oil prior to combusting the at least the portion of the captured oil.
9. The method of any one of paragraphs 1 to 8, wherein combusting the at least the portion of the captured fluid via the at least one floating burner comprises injecting air from an air compressor into the at least one floating burner.
10. The method of any one of paragraphs 1 to 9, wherein combusting the at least the portion of the captured fluid via the at least one floating burner comprises injecting a combustible fluid into the at least one floating burner.
11. The method of any one of paragraph 10, wherein the combustible fluid is one or more of methane, LPG, propane and butane.
12. The method of paragraph 10, wherein the combustible fluid is diesel. 13. The method of paragraph 10, wherein the combustible fluid is gasoline.
14. The method of paragraph 10, wherein the combustible fluid is a marine fuel oil.
15. The method of any one of paragraphs 1 to 14, wherein combusting the at least the portion of the captured fluid via the at least one floating burner comprises managing the hydrocarbon-to-air ratio of the at least one floating burner.
16. The method of paragraph 15, wherein managing the hydrocarbon-to-air ratio of the at least one floating burner comprises measuring the oxygen content of the at least one floating burner via an oxygen sensor.
17. The method of any one of paragraphs 15 to 16, wherein managing the hydrocarbon-to-air ratio of the at least one floating burner comprises measuring the temperature of the at least one floating burner via a temperature sensor.
18. The method of any one of paragraphs 15 to 17, wherein managing the hydrocarbon-to-air ratio of the at least one floating burner comprises measuring the carbon dioxide content of the at least one floating burner via a carbon dioxide sensor.
19. The method of any one of paragraphs 15 to 18, wherein managing the hydrocarbon-to-air ratio of the at least one floating burner comprises adjusting the amount of air injected into the at least one floating burner.
20. The method of any one of paragraphs 15 to 19, wherein managing the hydrocarbon-to-air ratio of the at least one floating burner comprises adjusting the amount of methane, diesel, gasoline, or marine fuel oil injected into the at least one floating burner.
21. The method of any one of paragraphs 1 to 20, wherein marine vessel has a length less than 120 feet in length.
22. The method of any one of paragraphs 1 to 21, wherein towing at least one boom, at least one floating burner and at least one skimmer from the marine vessel through a body of water comprises towing a first boom, a first floating burner and a first skimmer from a first side of the marine vessel and towing a second boom, a second floating burner and a second skimmer from a second side of the marine vessel, wherein the second side is opposite the first side.
23. The method of any one of paragraphs 1 to 22, wherein towing at least one boom, at least one floating burner and at least one skimmer from the marine vessel through a body of water comprises: towing a first boom and a first skimmer from a first side of the marine vessel; towing a second boom and a second skimmer from a second side of the marine vessel, wherein the second side is opposite the first side; towing a floating burner disposed adjacent to the first boom and the second boom.
24. A system for managing an oil release, comprising: a marine vessel; at least one boom configured to be towed from the marine vessel and to contain oil within the boom when being towed; at least one skimmer configured to capture fluid; and at least one floating burner coupled to at least one skimmer and configured to be towed from the marine vessel, receive the captured fluid from the at least one skimmer and combust the captured fluid.
25. The system of paragraph 24, wherein marine vessel has a length less than 120 feet in length.
26. The system of any one of paragraphs 24 to 25, wherein the at least one floating burner comprises: a burner section that comprises: a stack; a reservoir tank; coupled to the stack with an air gap disposed between the reservoir tank and the stack; a reservoir cup disposed within the reservoir tank and configured to flow fluids from the rim of the reservoir cup into the reservoir tank; an air injection line disposed in the reservoir cup and configured to provide air in a direction toward the stack; and a captured fluid injection line configured to provide captured fluid from the skimmer into reservoir cup; and a floatation section coupled to the burner section and configured to maintain the stack, reservoir cup and reservoir tank above the surface of a body of water.
27. The system of paragraph 26, wherein the air injection line is configured to provide air into the reservoir tank in a direction toward the stack.
28. The system of any one of paragraphs 26 to 27, wherein air injection line is configured to be below the captured fluid level in the reservoir cup.

It should be understood that the preceding is merely a detailed description of specific embodiments of the invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

The invention claimed is:

1. A method for managing an oil release, comprising:

towing at least one boom, at least one floating burner and at least one oleophilic skimmer from a marine vessel through a body of water;

containing oil in the body of water within the at least one boom;

capturing a fluid within the boom via the at least one oleophilic skimmer;

passing the captured fluid via tubing to the at least one floating burner; and combusting at least a portion of the captured fluid via the at least one floating burner, wherein the at least one floating burner includes a floatation section and a burner section, the burner section positioned on the floatation section above a surface of the body of water, the burner section including a captured fluid injection line in fluid communication with the tubing.

2. The method of claim 1, wherein capturing the fluid within the boom via the at least one skimmer comprises:

passing an oil-attracting material through the body of water;

moving the oil-attracting material from the body of water into a skimmer body; and removing the captured fluid from the oil-attracting material.

3. The method of claim 1, wherein the captured fluid comprises at least 80 volume percent hydrocarbons.

4. The method of claim 1, wherein the captured fluid comprises at least 90 volume percent hydrocarbons.

5. The method of claim 1, wherein the captured fluid comprises 99 volume percent hydrocarbons.

6. The method of claim 1, comprising treating the captured fluid with a demulsifying fluid prior to passing the captured fluid to the at least one floating burner.

7. The method of claim 1, wherein passing the captured fluid to the at least one floating burner comprises heating the captured fluid prior to combusting the captured fluid.

8. The method of claim 1, wherein combusting the captured fluid via the at least one floating burner comprises injecting air from an air compressor into the at least one floating burner.

9. The method of claim 1, wherein combusting the captured fluid via the at least one floating burner comprises injecting a combustible fluid into the at least one floating burner.

10. The method of claim 9, wherein the combustible fluid is methane.

11. The method of claim 9, wherein the combustible fluid is diesel.

12. The method of claim 9, wherein the combustible fluid is gasoline.

13. The method of claim 9, wherein the combustible fluid is a marine fuel oil.

14. The method of claim 1, wherein combusting the captured fluid via the at least one floating burner comprises managing a hydrocarbon-to-air ratio of the at least one floating burner.

15. The method of claim 14, wherein managing the hydrocarbon-to-air ratio of the at least one floating burner comprises measuring an oxygen content of the at least one floating burner via an oxygen sensor.

16. The method of claim 14, wherein managing the hydrocarbon-to-air ratio of the at least one floating burner comprises measuring a temperature of the at least one floating burner via a temperature sensor.

17. The method of claim 14, wherein managing the hydrocarbon-to-air ratio of the at least one floating burner comprises measuring a carbon dioxide content of the at least one floating burner via a carbon dioxide sensor.

18. The method of claim 14, wherein managing the hydrocarbon-to-air ratio of the at least one floating burner comprises adjusting an amount of air injected into the at least one floating burner.

19. The method of claim 14, wherein managing the hydrocarbon-to-air ratio of the at least one floating burner comprises adjusting an amount of methane, diesel, gasoline, or marine fuel oil injected into the at least one floating burner.

20. The method of claim 1, wherein marine vessel has a length less than 120 feet in length.

21. The method of claim 1, wherein towing at least one boom, at least one floating burner and at least one oleophilic skimmer from the marine vessel through the body of water comprises towing a first boom, a first floating burner and a first oleophilic skimmer from a first side of the marine vessel and towing a second boom, a second floating burner and a second oleophilic skimmer from a second side of the marine vessel, wherein the second side is opposite the first side.

22. The method of claim 1, wherein towing at least one boom, at least one floating burner and at least one oleophilic skimmer from the marine vessel through the body of water comprises:

towing a first boom and a first oleophilic skimmer from a first side of the marine vessel;

towing a second boom and a second oleophilic skimmer from a second side of the marine vessel, wherein the second side is opposite the first side;

towing a floating burner disposed adjacent to the first boom and the second boom.

23. A system for managing an oil release, comprising:

a marine vessel;

at least one boom configured to be towed from the marine vessel and to contain oil within the boom when being towed;

at least one oleophilic skimmer configured to capture fluid; and at least one floating burner coupled to the at least one oleophilic skimmer and configured to be towed from the marine vessel, receive the captured fluid from the at least one oleophilic skimmer via tubing and combust at least a portion of the captured fluid, the at least one floating burner includes a floatation section and a burner section, the burner section positioned on the floatation section above a surface of a body of water, the burner section including a captured fluid injection line in fluid communication with the tubing.

24. The system of claim 23, wherein marine vessel has a length less than 120 feet in length.

25. The system of claim 23, wherein the burner section comprises:

a stack;

a reservoir tank; coupled to the stack with an air gap disposed between the reservoir tank and the stack;

a reservoir cup disposed within the reservoir tank and configured to flow fluids from a rim of the reservoir cup into the reservoir tank;

an air injection line disposed in the reservoir cup and configured to provide air in a direction toward the stack; and the captured fluid injection line configured to provide captured fluid from the skimmer into the reservoir cup.

26. The system of claim 25, wherein the air injection line is configured to provide air into the reservoir tank in a direction toward the stack.

27. The system of claim 25, wherein air injection line is configured to be below the captured fluid level in the reservoir cup.

* * * * *